US006168044B1

(12) United States Patent
Zettle et al.

(10) Patent No.: US 6,168,044 B1
(45) **Date of Patent: *Jan. 2, 2001**

(54) CONTAINER HAVING A SNAP FIT SELECTIVELY DETACHABLE LID

(75) Inventors: Jeffey J. Zettle, Bay City, MI (US); Daniel C. Wilson, Carmel, IN (US); Donald E. Hodge, Clare; Eric B. Schaper, Midland, both of MI (US)

(73) Assignee: S. C. Johnson Home Storage, Inc., Racine, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/104,508

(22) Filed: Jun. 25, 1998

(51) Int. Cl.[7] ..... B65D 41/16

(52) U.S. Cl. ..... 220/784; 220/790; 220/791; 220/793

(58) Field of Search ..... 220/780, 782, 220/784, 787, 790, 791, 788, 793

(56) References Cited

U.S. PATENT DOCUMENTS

| | | | | |
|---|---|---|---|---|
| 3,065,875 | * | 11/1962 | Negoro | 220/784 |
| 3,401,825 | * | 9/1968 | Weiss | 220/787 |
| 3,458,079 | * | 7/1969 | Gasbarra | 220/787 |
| 3,516,572 | * | 6/1970 | Davis | 220/784 |
| 3,583,596 | * | 6/1971 | Brewer | 220/784 X |
| 4,026,459 | * | 5/1977 | Blanchard | 220/784 X |
| 4,194,645 | * | 3/1980 | Zabner et al. | 220/784 X |
| 4,256,240 | * | 3/1981 | Woinarski | 220/782 |
| 4,293,080 | | 10/1981 | Letica . | |
| 4,335,827 | * | 6/1982 | Knize et al. | 220/284 |
| 4,351,447 | | 9/1982 | Graff . | |
| 4,457,447 | | 7/1984 | Kirkis . | |
| 4,474,305 | | 10/1984 | Marco . | |
| 4,494,674 | | 1/1985 | Roof . | |
| 4,555,043 | | 11/1985 | Bernhardt . | |
| 4,555,056 | | 11/1985 | Bernhardt . | |
| 4,702,389 | * | 10/1987 | Bozinovich et al. | 220/784 |
| 4,721,210 | | 1/1988 | Lawrence et al. . | |
| 4,741,452 | | 5/1988 | Holzkopf . | |
| 4,742,934 | | 5/1988 | Michaud et al. . | |
| 4,804,092 | | 2/1989 | Jones . | |
| 4,819,834 | | 4/1989 | Longbottom et al. . | |
| 4,836,407 | | 6/1989 | Bruce et al. . | |
| 4,886,184 | | 12/1989 | Chamourian . | |
| 4,976,370 | | 12/1990 | Cassel . | |
| 5,092,479 | | 3/1992 | Wells . | |
| 5,108,768 | | 4/1992 | So . | |
| 5,129,517 | | 7/1992 | Hustad . | |
| 5,269,430 | | 12/1993 | Sclaupitz et al. . | |
| 5,375,719 | | 12/1994 | Mittmann et al. . | |
| 5,377,860 | * | 1/1995 | Littlejohn et al. | 220/790 |
| 5,507,407 | | 4/1996 | Feer et al. . | |
| 5,553,701 | | 9/1996 | Jarecki et al. . | |
| 5,577,613 | | 11/1996 | Laidlaw . | |
| 5,607,709 | | 3/1997 | Fritz et al. . | |
| 5,702,025 | * | 12/1997 | Di Gregorio | 220/717 |
| 5,772,070 | * | 6/1998 | Hayes et al. | 220/781 |
| 5,915,581 | * | 6/1999 | Pfirrmann, Jr. et al. | 220/784 X |

FOREIGN PATENT DOCUMENTS

| | | |
|---|---|---|
| 19 55 162 | 5/1971 | (DE) . |
| 2 136 775 | 9/1984 | (GB) . |
| 2 257 118 | 1/1993 | (GB) . |
| WO 96 15042 | 5/1996 | (WO) . |

* cited by examiner

*Primary Examiner*—Stephen K. Cronin

(57) ABSTRACT

A resilient microwavable container including a bowl and a selectively detachable snap on lid is disclosed. The lid includes a plurality of protrusions which snap over a pair of annular flanges extending outwardly from the bowl whereby a distinct clicking sound can be heard to verify the lid is properly attached.

14 Claims, 3 Drawing Sheets

CONTAINER HAVING A SNAP FIT SELECTIVELY DETACHABLE LID

BACKGROUND OF THE INVENTION

1. Technical Field

The present invention generally relates to a container useful for storing and transporting items such as food and, more particularly, to a container including a bowl and a snap fit selectively detachable lid.

2. Description of the State of the Art

Containers, particularly those used for reheating foodstuffs in a microwave oven generally should be relatively low in cost and easy to utilize. Additionally, such containers should be versatile to use, that is, capable of withstanding drastically different environments such as occurs when transferring the container directly from the refrigerator or freezer to a microwave oven, for example.

With regard to these microwavable containers, while a primary focus in the art has been on providing a good seal between the lid and the bowl, relatively little attention has been paid to the physical integrity of the mechanical attachment between the lid and the bowl. Further, known commercially available microwavable containers fail to provide an audible sound which is indicative that the lid and the bowl are in sealing engagement upon attachment.

OBJECTS AND SUMMARY OF THE INVENTION

It is therefore a primary object of the present invention to provide a container including a bowl and a selectively detachable lid including a sealing arrangement which allows for relatively easy attachment and detachment.

Another object of the present invention is to provide a low cost, high production volume container made from a resilient material.

Still another object of the present invention is to provide a container which provides an audible sound upon attachment of the lid to the bowl which is indicative that a good seal has been made.

Still another object of the present invention is to provide a lid which resists inadvertent detachment from the corresponding bowl.

Yet another object of the present invention is to provide a resilient container which is useful in various environments such as refrigerator freezers and microwave ovens.

In accordance with the teachings of the present invention, a microwavable container is provided that includes a bowl and a selectively detachable lid, each having outwardly extending lips. The bowl and lid lip have at least one, and preferably, a series of protrusions and flanges thereon which slidingly engage each other during attachment and detachment of the lid from the bowl in such a manner that an audible clicking sound is made to verify that the container is sealed. The cooperation of the protrusions with the flanges, in the sealed position, resists inadvertent detachment of the lid from the bowl. In one embodiment, the bowl lip includes at least one substantially annular outwardly extending flange and the lid lip has at least one inwardly extending protrusion. In an alternative embodiment, the bowl lip includes at least one outwardly extending protrusion while the lid lip includes at least one inwardly extending flange.

The container of the present invention can be economically thermo-formed from any one of a number of known thermoplastic resins including but not limited to polyamides, polyacrylics, polyarylates, polycarbonates, polyesters, polyetherimides, polyetherketones, polyolefins, polyphenylenes, polyvinylchlorides, and various styrene and liquid crystal polymers, among others.

The various features, objects and advantages of the present invention should become still more apparent from a review of the following description of the drawings and invention in detail.

DETAILED DESCRIPTION OF THE INVENTION

Figure 1:
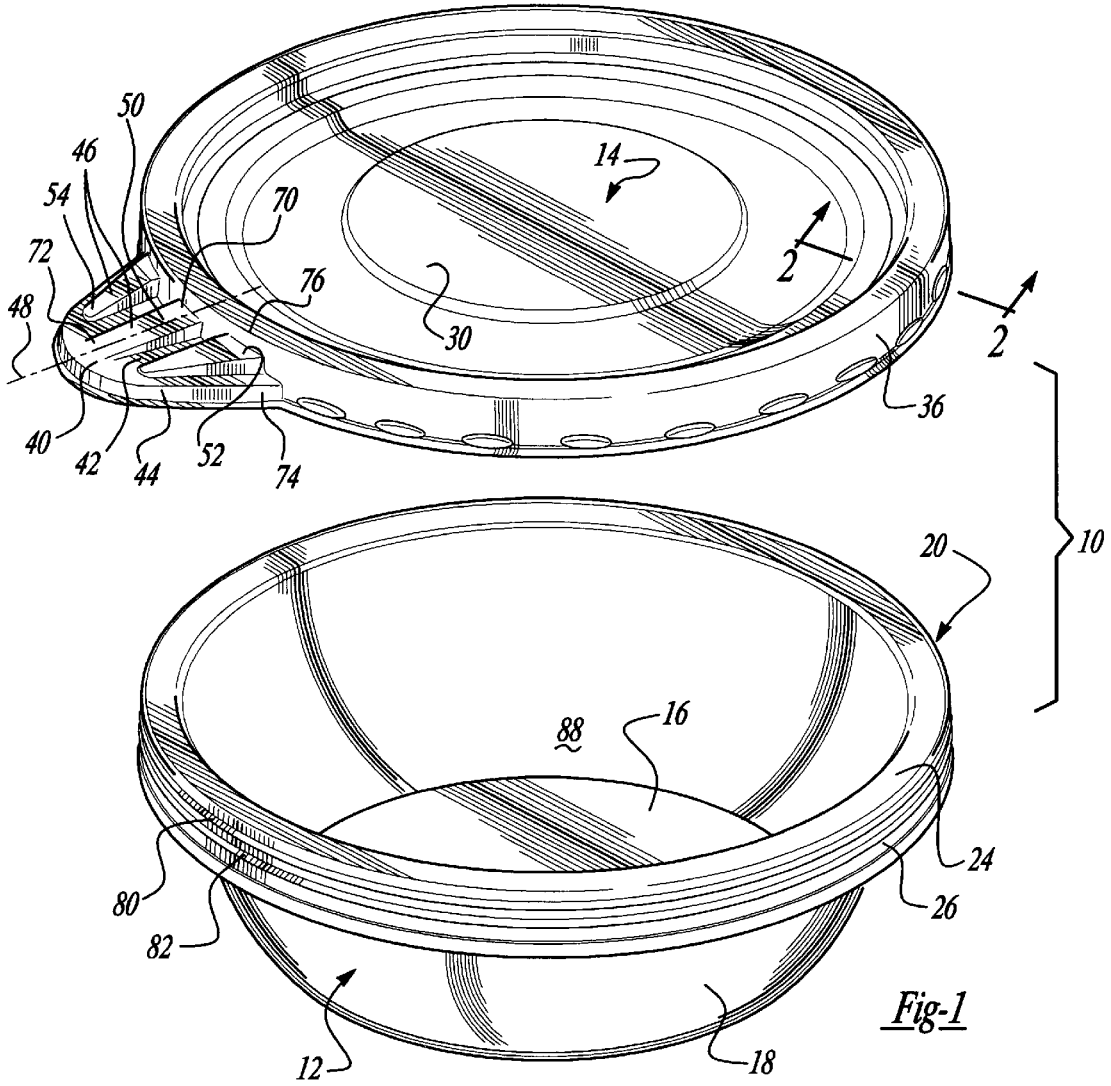
FIG. 1 is a disassembled perspective view of a container made in accordance with the teachings of the present invention.

Referring generally to FIG. 1, there is shown a container 10 including a bowl 12 and selectively detachable lid 14 formed in accordance with the teachings of the present invention. From the outset, it should be noted that while the container is illustrated generally as being round, the container may be of various other configurations such as oval, rectangular or square by way of non-limiting examples.

The bowl 12 generally includes a bottom 16 and a continuous side wall 18 extending vertically from the bottom defining a bowl cavity 88. Integrally connected to the vertically extending sidewall is a substantially L-shaped continuous lip 20 including a first leg 24 which extends outwardly from the sidewall and a second leg 26 which extends downwardly from the first leg. The second leg 26 of the continuous lip includes a pair of spaced apart outwardly extending substantially annular flanges 80 and 82, respectively. By "substantially annular" it is meant the flanges 80 and 82 should extend around a majority of the second leg, however the flanges need not be continuous.

Figure 3:
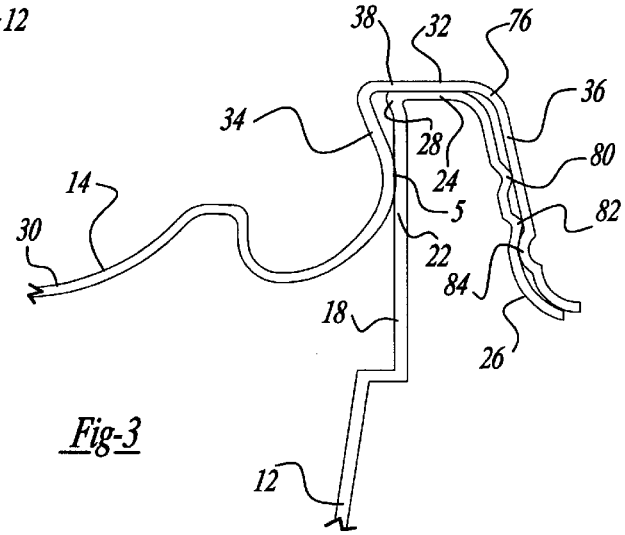
FIG. 3 is an assembled perspective view of the container.
Figure 5:
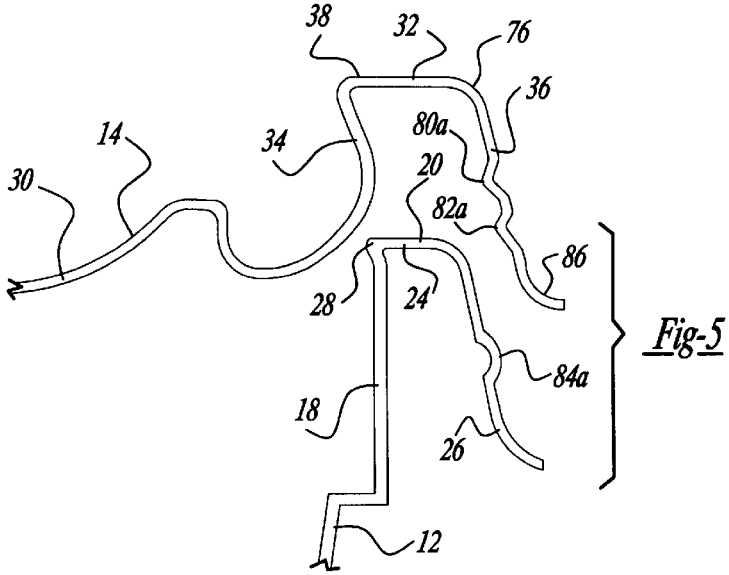
FIG. 5 is a disassembled sectional view of the container of FIG. 4 taken along line 5—5.

As can be seen more clearly with reference to FIG. 3, the upper portion 22 of the sidewall 18 preferably includes an inwardly extending annular nub 28 which assists in confirming the sealing engagement between the lid and the bowl as will be described in greater detail below.

The lid 14 generally includes a body 30 having a peripherally disposed lip 32 which overlays a portion of the lip 20 provided on the bowl upon attachment. The lip 32 generally has an inverted U-shape in cross section including a first leg 34 which extends from the body, a second leg 36 and a web 38 disposed therebetween as shown most clearly in FIG. 3. Extending inwardly from the second leg 36 of the lip 32 is a plurality of spaced apart circumferentially spaced protrusions 84. The protrusions 84 which generally are disposed in proximity to the terminal edge 86 of the second leg 36 are preferably rounded to reduce the separation force required to detach the lid from the bowl. Preferably, the total number of protrusions will include at least 10 and, more preferably, will number 20 or more. As illustrated, it is also preferable that the protrusions 84 be spaced equidistantly about the lip 32.

Upon joining the lid 14 to the bowl 12, the protrusions 84 snap over both annular flanges 80 and 82 thereby assisting in securing the lid to the bowl. As the protrusions snap over the annular flanges, the snap action provides a distinctive clicking sound which provides an auditory indication that the interfitting seal between the lid and bowl has been accomplished. This so-called interfitting seal occurs when the first leg 34 of lip 32 is advanced over the annular nub 28 until the sealing point engages the inner surface of the side wall 18, as shown in FIG. 3.

A rigid tab member 40 designed to resist bending at the point of attachment to the sealing lip 32 is provided and extends outwardly from the second leg 36. The tab member 40 which is substantially triangular in shape is shown as including a floor 42 and a peripheral edge 44. The floor 42 is provided with a plurality of spaced apart upstanding ribs 46 including a first rib 50 disposed along a longitudinal center line drawn through the tab as designated by reference numeral 48. Disposed on opposite sides of the first rib, are second and third ribs 52 and 54, respectively, which extend angularly away from the longitudinal center line 48. Each of the ribs are defined by rather abrupt edges which further enhance the structural rigidity of the tab member.

The ribs are positioned at specific locations to maximize the tab's rigidity and thereby enhance the transfer of separation forces from the tab member to the sealing region, i.e., enhance the releasability of the lid from the bowl when desired. For example, the first rib 50 includes a first transverse edge relative to the floor which extends at an angle of between about 3° to about 7° from the longitudinal center line and a second transverse edge extending at an angle of between about −3° to about −7° from the longitudinal center line. Thus, the first rib is generally trapezoidal in shape.

The second rib 52 includes a first transverse edge extending at an angle of between about 8° to about 12° from the longitudinal center line 48 and a second transverse edge extending at an angle of between about 20° to about 40° from the longitudinal center line. The third rib 54 which is the mirror image of the above described second rib extends at an angle of between about −8° to about −12° along a first transverse edge and at an angle of between about −20° to about −40° from the longitudinal center line along a second transverse edge. Thus, as shown and described with regard to the preferred angular orientations, the second and third ribs extend angularly away from the longitudinal center line and are substantially triangular in shape.

It should be noted that the negative degree designations (−°) relative to the longitudinal center line are utilized herein for clarity and to emphasize that the second and third ribs are preferably mirror images of each other. As such, one skilled in the art should readily recognize, for example, that −3° is equivalent to 357° and −7° is equivalent to 353° utilizing standard radius expressions.

According to a preferred embodiment, each of the upstanding ribs include a first end 70 terminating proximate to the lip 32 and a second end 72 terminating proximate to the peripheral edge 44 of the tab. The upstanding ribs are generally sloped upwardly from the second end to the first end at an average inclination of between about 12° to 18° such that the ribs join the lip 32 near the junction 76 between the web 38 and second leg 36. The peripheral edge of the tab member preferably includes a downturned flange 74 which extends below the floor 42 and thus provides a barrier to prevent a user's thumb or finger from sliding off of the tab member.

In order to remove the lid from the bowl, the user pulls up on the tab member 40 to break the interfitting seal 5. As the lid is pulled away from the bowl, the protrusions 84 are thus pulled over the annular flanges 80 and 82 thus causing the same clicking sound as is heard upon attachment of the lid.

Figure 2:
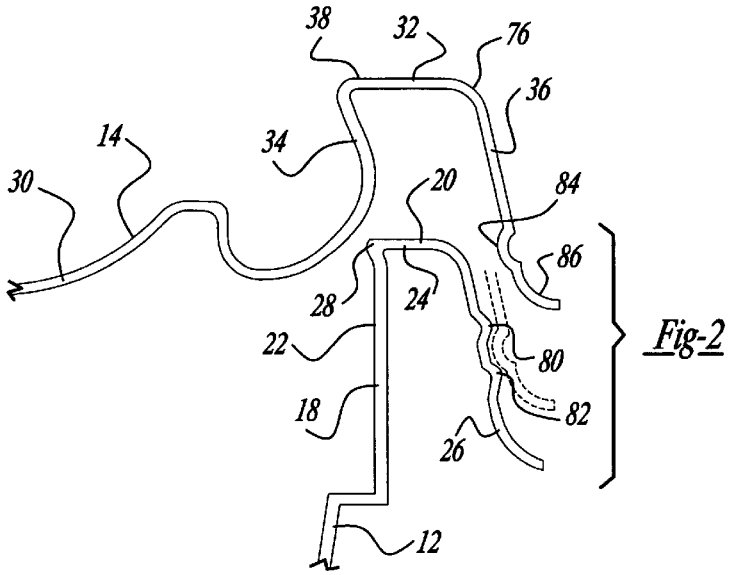
FIG. 2 is a disassembled sectional view of the container of FIG. 1 taken along line 2—2.
Figure 4:
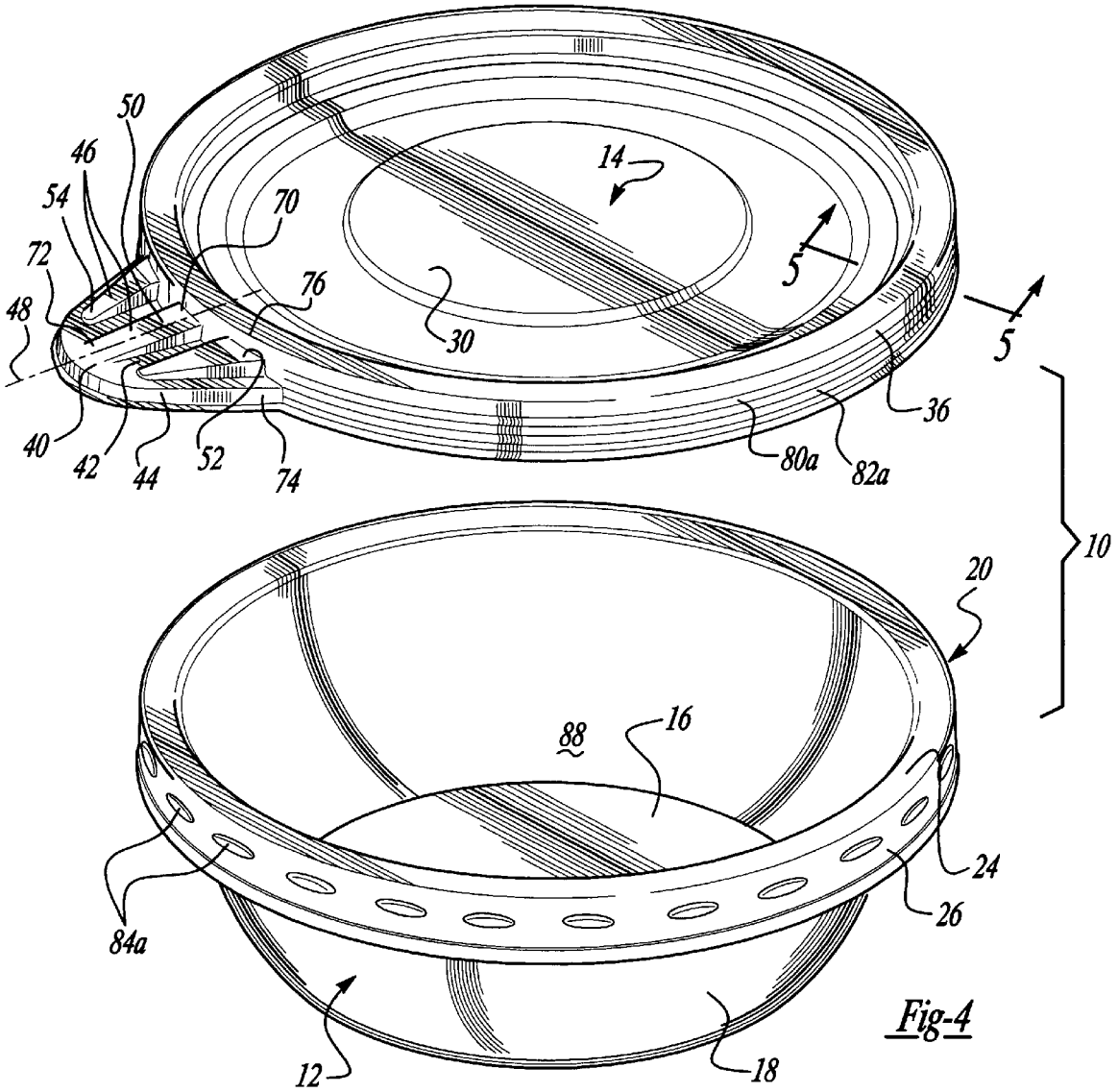
FIG. 4 is a disassembled perspective view of an alternative embodiment of a container made in accordance with the teachings of the present invention.

Referring to FIG. 4, there is shown an alternative embodiment of the container 10. According to this embodiment, a series of protrusions 84*a* are disposed on the second leg 26 of the bowl's lip 20 and the substantially annular flanges 80*a* and 82*a* extend inwardly from the second leg 36 of the lid's lip 32. Thus, the flanges 80*a* and 82*a* respectively snap over the protrusions 84*a* which results in the unique clicking sound heard upon attachment and detachment of the lid from the bowl. In other respects, the container is preferably the same as the container shown in FIGS. 1–3.

As should be understood upon review of the foregoing description, the lid and bowl assembly forming the container are provided with a significant mechanical resistance to undesired detachment of the lid from the bowl. However, the mechanical resistance offered by the annular flanges and protrusions do not substantially increase the separation force required to break the interfitting seal when detachment of the lid from the bowl is desired. Further, the audible clicking sound which is heard upon attachment of the lid to the bowl clearly indicates to the user that a sealing relationship between the components has been accomplished.

As noted, while the lid and bowl may be thermo-formed from any one of a number of different polymeric materials, a polypropylene homopolymer optionally including a slip agent is considered to be preferable. Bu utilizing a polypropylene homopolymer, the lid and bowl can be thermoformed to have an average thicknesses of between about 10 to 50 mils and still offer the necessary structural integrity.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A resilient microwavable container comprising:

a bowl including a cavity and an outwardly extending lip having a plurality of outwardly extending substantially annular flanges; and a selectively detachable lid including an outwardly extending lip having a plurality of inwardly extending protrusions spaced equidistantly along a circumference of said lid lip, said protrusions snap over said plurality of flanges during attachment of said lid to said bowl;

whereby, upon attaching said lid to said bowl, an audible clicking sound is made indicating said container is sealed.

2. The container of claim 1, including at least ten of said protrusions.

3. The container of claim 1, wherein said lip of said lid includes a first leg which seats within said cavity of said bowl, a second leg, and a web extending between said first and second legs, said second leg including said inwardly extending protrusions.

4. The container of claim 1, wherein said lip of said lid further comprises at least one rigid tab member extending outwardly therefrom.

5. The container of claim 1, wherein said inwardly extending protrusions are rounded.

6. A resilient microwavable container comprising:

a bowl including a bottom, a continuous side wall extending outwardly from said side wall including a pair of substantially annular outwardly extending flanges; and a selectively detachable lid including a peripheral sealing lip including an outwardly extending tab member and a plurality of inwardly extending protrusions equidistantly spaced along a circumference of said lid lip;

whereby, upon attaching said detachable lid to said bowl, said plurality of inwardly extending protrusions snap over said annular flanges to provide an audible clicking sound indicating said container is sealed.

7. The container of claim 6, including at least ten of said inwardly extending protrusions.

8. The container of claim 6, wherein said sealing lip includes a first leg and a second leg having a web extending therebetween.

9. The container of claim 8, wherein said inwardly extending protrusions are disposed on said second leg.

10. The container of claim 9 wherein said inwardly extending protrusions are rounded.

11. A resilient microwavable container comprising:

a bowl including a cavity and an outwardly extending lip having a plurality of spaced apart outwardly extending protrusions spaced equidistantly along a circumference thereof; and a selectively detachable lid including a lip having a plurality of inwardly extending substantially annular flanges which snap over said plurality of protrusions provided on said bowl lip during attachment of said lid to said bowl;

whereby upon attaching the lid to the bowl an audible clicking sound is made to verify that the container is sealed.

12. The container of claim 11, wherein said lid lip includes a first leg which seats within said bowl cavity, a second leg, and a web extending therebetween, said second leg including said inwardly extending flanges.

13. The container of claim 12, including at least 10 of said protrusions.

14. The container of claim 11, wherein said inwardly extending protrusions are rounded.

* * * * *